United States Patent [19]

Hanyu et al.

[11] Patent Number: 4,579,615

[45] Date of Patent: Apr. 1, 1986

[54] METHOD AND A DEVICE FOR CONNECTING THREADS OF A SEWING MACHINE

[75] Inventors: Susumu Hanyu, Tokyo; Reishi Nomoto, Kanagawa; Kazumasa Hara, Hino, all of Japan

[73] Assignee: Janome Sewing Machine Co. Ltd., Tokyo, Japan

[21] Appl. No.: 633,095

[22] Filed: Jul. 20, 1984

[30] Foreign Application Priority Data

Jul. 23, 1983 [JP] Japan ..... 58-133619

[51] Int. Cl.[4] ..... B65H 62/02; D04H 15/00

[52] U.S. Cl. ..... 156/159; 156/433; 156/509; 242/35.6 R

[58] Field of Search ..... 156/158, 159, 180, 441, 156/433, 502, 504, 304.3, 304.2, 508, 505, 506, 509; 57/22, 23, 261; 242/35.6 R, 35.6 E; 78/208, 209, 141

[56] References Cited

U.S. PATENT DOCUMENTS

| | | | |
|---|---|---|---|
| 2,298,676 | 10/1942 | Camp | 156/158 |
| 3,070,947 | 1/1963 | De Toledo et al. | 156/158 |
| 3,741,836 | 6/1975 | Williams | 156/159 |
| 3,850,377 | 11/1975 | Pitts et al. | 242/35.6 R |
| 3,892,432 | 7/1975 | Ingus | 242/35.6 R |
| 4,232,509 | 11/1980 | Rohner | 242/35.6 R |

*Primary Examiner*—Michael Ball

*Attorney, Agent, or Firm*—Michael J. Striker

[57] ABSTRACT

A thread connecting device for a sewing machine cuts an upper thread which is extending between the sewing machine and one of a plurality of thread spools, and connects an end of a thread belonging to the sewing machine and an end of a thread belonging to the thread spool, in such a manner that the connected part of the threads can smoothly pass through a needle eye, whereby it is possible to supply a desired color thread with respect to the sewing machine having a single needle bar. Therefore the applicable scope of the pattern stitching may be largely widened for colored clothes or other fabrics, especially an embroidery stitching may be performed which requires many kinds of color threads.

14 Claims, 10 Drawing Figures

METHOD AND A DEVICE FOR CONNECTING THREADS OF A SEWING MACHINE

FIELD OF THE INVENTION

This invention relates to a method and a device for connecting threads of a sewing machine, which comprises cutting an upper thread extending between the sewing machine and one of a plurality of thread spools, and connecting an end of the thread belonging to the sewing machine and an end of a thread of a selected color belonging to the thread spools.

BACKGROUND OF THE INVENTION

During stitching operation of the sewing machine, especially pattern stitching or embroidery stitching, for example, a plurality of threads of different colors are prepared, and when a color of an upper thread is changed during operation, it is necessary to lift up a presser foot, cut the upper thread, remove it from the sewing machine, set an upper thread of a different color to the sewing machine, and pass it through thread guides, a thread tension, a take-up lever and others. Such a sequential process is troublesome, and if the colored threads are often changed, a great deal of time is taken up therefor.

As another example, in machines, e.g., an embroidery machine which uses various kinds of colored threads, many needle bars are in advance set with threads of different colors to be selected and changed.

SUMMARY OF THE INVENTION

It is an object of the present invention is to provide a thread connecting device for a sewing machine, which cuts an upper thread extending between one of a plurality of thread spools and the sewing machine, and connects a thread end belonging to the sewing machine and a thread end belonging to a thread spool of the desired color in such a manner that the connected part of the thread can smoothly pass through a needle eye of the sewing machine, whereby it is possible to supply a desired color thread with respect to the sewing machine having a single needle bar. Therefore an applicable scope of pattern stitching may be largely widened for colored clothes or other fabrics, especially the embroidery stitching may be easily performed which requires many kinds of color threads.

The attached drawings illustrate the most preferred embodiment of the invention.

BRIEF DESCRIPTION OF THE DRAWINGS

FIG. 6 is a condition before cutting the thread;

FIG. 7 is a condition of cutting the thread;

FIG. 8 is a condition after cutting the thread, the thread cutting device holds, as shown with two-dotted line, an end of the thread belonging to the thread spool, and rotates it about 180° in clockwise direction;

FIG. 9 is a condition in which the thread connecting device connects the thread end of the spool and the thread end of the sewing machine, as shown with solid line, and rotates slightly in counterclockwise direction, as shown with two-dotted line.

DETAILED DESCRIPTION OF THE INVENTION

Figure 1:
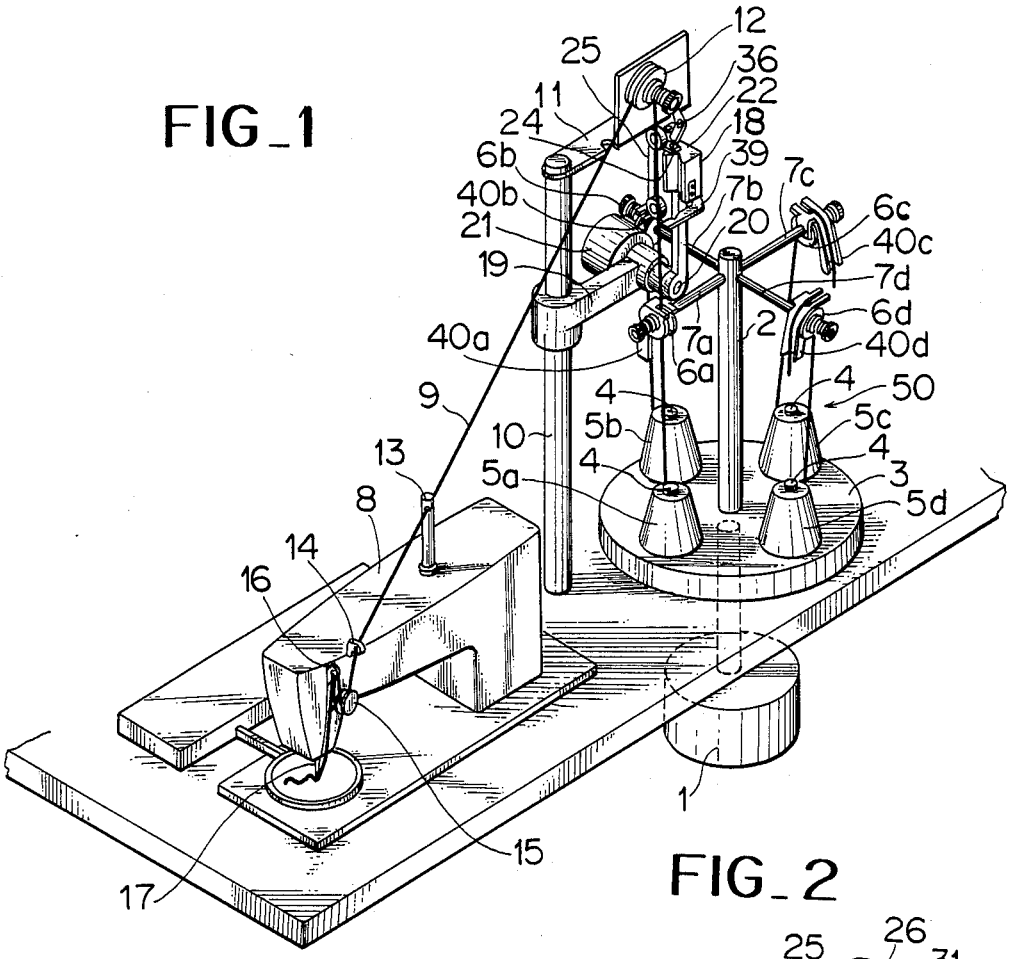
FIG. 1 is a perspective view showing a thread connecting device and a sewing machine.

An embodiment of the invention will be explained in reference to the attached drawings. In FIG. 1, a driving means 1 such as a pulse motor controls rotation of a turret shaft 2 secured with a turret disc 3 on which a plurality of shafts 4 are implanted. The shafts 4 are mounted with a plurality of thread spools 5*a*, 5*b* . . . 5*d* ("5" represents them hereafter) coiling different colored threads respectively, and these members compose an upper thread spool 50. The turret shaft 2 is provided, via shafts 7*a*, 7*b* . . . 7*d*, with a plurality of pretensions 6*a*, 6*b* . . . 6*d* ("6" represents them hereafter) each corresponding to said thread spools 5.

An upper thread 9 is pulled out from one of the plurality of the thread spools 5 and is guided to the corresponding pretension 6 and to a pretension 12 disposed on an attaching plate 11 of a column 10, and is guided to an eye of a needle 17 via thread guides 13 and 14 of a sewing machine 8, a thread tension 15 and a take-up lever 16.

The column 10 has a stationary bed 19 which holds a motor 21, and an output shaft 20 of the motor 21 holds a thread connecting means 18, so that its rotation is controlled by the motor 21 in certain relationship with respect to a thread extending between the pretensions 6 and 12.

As later mentioned, the thread connecting means 18 cuts the upper thread, and connects an end of the upper thread belonging to the sewing machine and an end of a thread belonging to a selected thread spool by the medium of a member whose melting point is lower than those of said threads.

Figure 3:
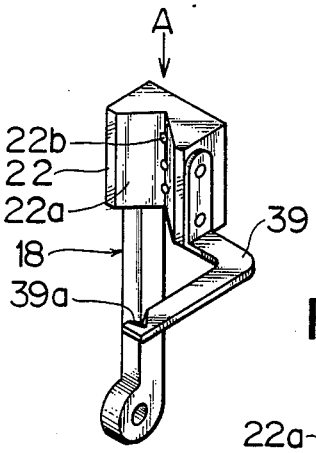
FIG. 3 is a perspective view of an element of the device seen from a reverse side.
Figure 4:
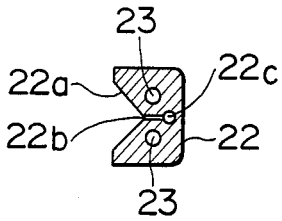
FIG. 4 is a lateral cross sectional view of a working portion of the device seen from arrow A of FIG. 3.
Figure 5:
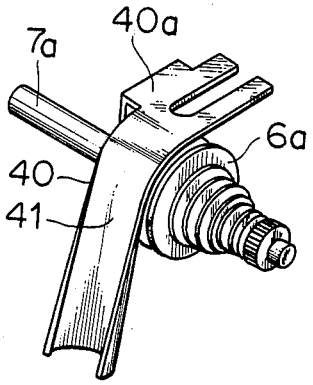
FIG. 5 is a perspective view of a pretension of a thread guide plate.

Herein, detailed explanation will be made to the thread connecting means, referring to FIGS. 2 to 4. A working portion 22 of the thread connecting means 18 is, as seen in FIG. 4, formed with a groove 22*a* of V shape in cross section, and in the bottom of which small holes 22*b* are perforated up to an air absorber (not shown) via a connecting hole 22*c*. Heating means 23, e.g., sheathed heater, are buried for heating the vicinity of the groove 22*a*.

A holder 24 is provided with a thread coiling part 27 and a thread storing part 26 which stores together connecting threads 25 of high melting point and low melting point. The connecting threads 25 are pulled out by a required amount from the thread storing part 26 by means of a motor 28 driving the thread coiling part 27.

Figure 2:
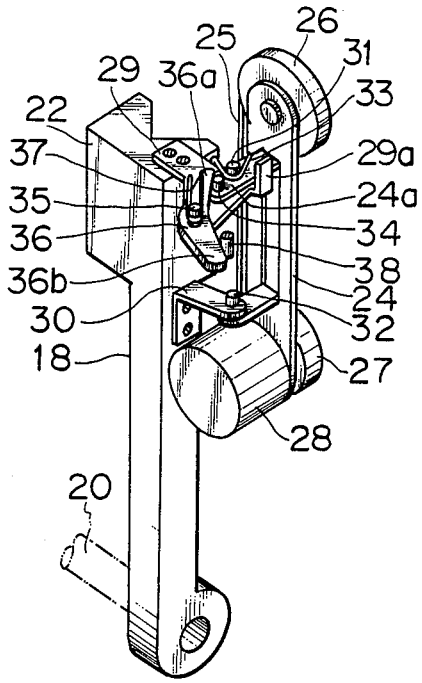
FIG. 2 is a perspective view of the thread connecting device.

The holder 24 is rotatable around pins 31 and 32 with respect to the working portion 22 via connecting means 29 and 30, and is biased in a clockwise direction, looking from the top of FIG. 2, by a spring 33 toward an inner face of a bent portion 29*a* of the connecting means 29.

The holder 24 has an extension 24*a* on which a pin 34 is implanted. The connecting means 29 has a pin 35 around which a lever 36 is turnably mounted, and one end 36*a* of the lever 36 is biased to said pin 34 by a spring 37. The spring 33 is stronger than the spring 37 so that the condition shown in FIG. 2 is provided. A pin 38 projects at a certain timing during changing a thread as later mentioned, and the other end 36*b* of the lever 36 is rotated in the clockwise direction around the pin 35. At the same time the thread connecting means 18 is rotated in the clockwise direction. The holder 24 is rotated via the pin 34 in a counterclockwise direction around the pins 31 and 32, so that the connecting threads 25 are pushed against the bottom of the groove 22*a* of the working portion 22.

The working portion 22 is fixed at its side with a cutter 39 having a cutting edge 39*a* which is positioned within moving loci of the upper thread 9 extending between the pretensions 6 and 12 when the turret disc is rotated as later mentioned.

The plurality of the pretensions 6*a*, 6*b* . . . 6*d* are each provided with thread guide plates 40*a*, 40*b* . . . 40*d* ("40" represents them hereafter), and thread guides 41 guide thread ends of the thread spools.

Figure 6:
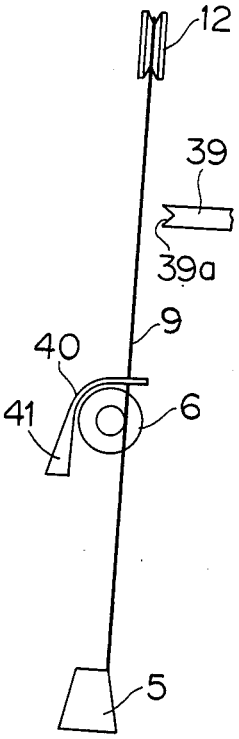
FIGS. 6 to 9 a schematic views illustrating cutting and connecting of the thread.
Figure 7:
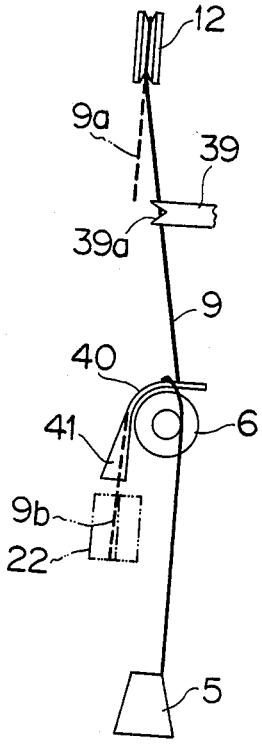

A further explanation will be made to actuation of the embodiment of the invention. FIG. 6 shows a condition a color thread from the thread spool 5 is used as an upper thread 9. When a thread changing signal is issued from a control device (not shown), the sewing machine 8 is stopped and the turret disc 3 is rotated in the counterclockwise direction in FIG. 1 together with the thread spool 5 and the pretensions 6. The thread 9 extending between the pretensions 6 and 12 is cut by the cutting edge 39*a* of the cutter 39. The thread 9*a* to the sewing machine after being cut is held by the pretension 12 as shown in FIG. 7 and is suspended as shown with a broken line in the same, while the thread 9*b* to the thread spool is guided to the thread guide 41 of the thread guide plate 40 and is suspended as shown with a broken line of the same.

The thread of each of the thread spools 5 is in advance set such that it is guided to the guide 41 of the guide plate 40 and is suspended as after having been cut as mentioned above, except threads having been set for initial use. After having cut the thread, the turret disc 3 is further rotated, and stopped when a desired thread spool 5 comes to a determined position.

Figure 8:
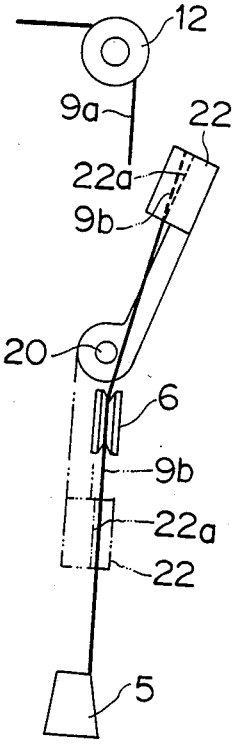

When the motor 21 is driven, the thread connecting device 18 is rotated around the shaft 20 in the counterclockwise direction in FIG. 1, and the thread end 9*b* of the desired thread spool is guided to the groove 22*a* of the working portion 22 and is fixedly held there by the air absorption from the air hole 22*c*. The thread end 9*b* is held and the motor 21 is rotated reversely in the clockwise direction in FIG. 1. The thread connecting means 18 is rotated about 180° and passes the thread end 9*a* of the sewing machine as shown with the solid line of FIG. 8, and is again rotated reversely in the counterclockwise direction until a position where the thread end 9*a* of the sewing machine is securely held to the bottom 22*a* of the working portion 22 by the action of the air absorption. Under this condition, the thread end 9*b* of the thread spool having been already held and the thread end 9*a* of the sewing machine to be held are positioned in the bottom of the groove 22*a*.

The motor 28 is rotated, and a connecting thread 25 is coiled on the thread coiling part 27 and is pulled out from the thread storing part 26 by a required amount.

Figure 9:
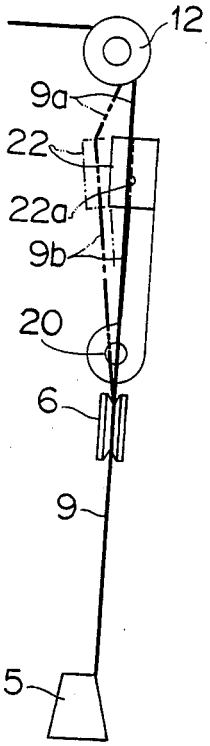

The pin 38 is projected (FIG. 2) by solenoid (not shown), and the thread connecting means 18 is slightly rotated in the counterclockwise direction in FIG. 9 to a condition as shown with two-dotted line. This rotation is the clockwise rotation of the thread connecting device 18 in FIG. 2. The lever 36 is rotated by the projecting pin 38 around the pin 35 in the counterclockwise direction. The holder 24 is rotated via the pin 34 in the counterclockwise direction. The connecting thread 25 pulled out by the determined amount is pushed to the bottom of the groove 22*a*, and the thread end 9*b* and the thread end 9*a* are positioned there. At the same time, the groove 22*a* is heated by the heating means 23, and the connecting thread 25 is melted in a part thereof to connect said thread ends 9*a* and 9*b*. After the time enough to connect them passes, the motor 21 rotates the thread connecting device 18 in the counterclockwise direction of FIG. 2, and the air absorbing device is stopped at this point.

The present embodiment uses rayon threads as colored threads of the thread spools 5 for the upper thread of the sewing machine and uses mixed threads of nylon of low melting point and ordinary nylon.

Figure 10:
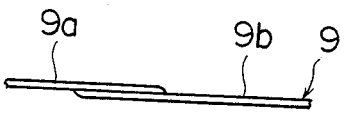
FIG. 10 is a view showing a connected condition of the ends of the threads of the sewing machine and the thread spool.

In the connecting upper thread 9 as seen in FIG. 10, the thread ends 9*a* and 9*b* are overlapped and connected by the medium of the nylon of the low melting point. The connecting portion can smoothly pass the pretension 12 and the thread tension 15 by releasing their action. After connection, the thread of the desired color is pulled out until it comes to the needle 17 of the sewing machine 8 by, e.g., a looper or a thread feed roller.

As having mentioned above, the present invention is to provide a thread connecting device for the sewing machine, which cuts the upper thread extending between one of the plurality of the thread spools and the sewing machine, and connects the thread end belonging to the sewing machine and the thread end belonging to the thread spool of the desired color in such a manner that the connected part of the thread can smoothly pass through the needle eye of the sewing machine, whereby it is possible to supply a desired color thread with respect to the sewing machine having a single needle bar. Therefore the applicable scope of the pattern stitching may be largely widened for the colored clothes or other fabrics, especially the embroidery stitching may be easily performed which requires many kinds of color threads.

What is claimed is:

1. A method for splicing a first thread to an end of a second thread of a sewing machine having a thread guide, a needle having an eye, and a plurality of thread supplies including a first thread supply which supplies the first thread to the needle eye through the thread guide, the method comprising the steps of: selecting a second thread supply from the plurality of thread supplies, and rotating it to a thread pick-up position; cutting the first thread between the thread guide and the first thread supply, thereby providing a cut end; picking up the end of the second thread of the second thread supply at the thread pick-up position, and picking up the cut end of the first thread so that the cut end of the first thread contacts the end of the second thread; contacting a meltable splicing thread to both the end of the second thread and the cut end of the first thread; melting the splicing thread so as to cause the end of the second thread to become spliced to the cut end of the first thread; said picking up step including picking up the end of the second thread and the cut end of the first thread by thread pick-up means cooperating with sucking means; and said splicing thread contacting step including swingably moving a holder mounted on said pick-up means, holding the splicing thread, to and away from the thread pick-up means.

2. A method as defined in claim 1, wherein said selecting and conveying a second thread supply step includes conveying the second thread supply to the thread pick-up position by rotating a carrier carrying the plurality of thread supplies.

3. A method as defined in claim 2, wherein said selecting and conveying step includes rotating the thread supply carrier by driving a pulse motor.

4. A method as defined in claim 2; and further comprising the step of holding one end of each thread of each of the thread supplies at a predetermined level.

5. A method as defined in claim 1, wherein said picking up step includes rotating the thread pick-up means to pick up the end of the second thread and the cut end of the first thread by driving a reversible motor.

6. A method as defined in claim 1, wherein said contacting step includes swingably moving the holder holding the splicing thread by driving a reversible motor.

7. A thread splicing apparatus as defined in claim 1, wherein said splicing thread has a composition including a nylon thread and a nylon which have different melting temperatures.

8. A thread splicing apparatus for a sewing machine having a thread guide, a thread tension, a thread take-up lever and a needle having an eye, the apparatus comprising: a plurality of thread supplies including a first one having a first thread supplied to the eye of the needle through the thread guide, the thread tension and the thread take-up lever; thread selecting means for selectively conveying a second one of said plurality of thread supplies having a second thread with one end to a thread pick-up position; cutter means for cutting said first thread at a point between the thread guide and the first thread supply so as to provide the first thread with a cut end and another end located in the eye of the needle; thread pick-up means having a thread pick-up face and being movable to pick-up said one end of said second thread from said second thread supply at said thread pick-up position and said cut end of said first thread; sucking means operatively connected with said thread pick-up means and being operable so as to press said ends of said first and second threads against said thread pick-up face in contact with each other; a splicing thread having a heat meltable composition for splicing said ends of said first and second threads; means for carrying said splicing thread, said means being movable between an inoperative position in which said splicing thread is spaced from said thread pick-up means and an operative position in which said splicing thread is in contact with said ends of said first and second threads; and heater means for heating said thread pick-up face of said thread pick-up means so as to melt said composition of said splicing thread and consequently splice said ends of said first and second threads.

9. A thread splicing apparatus as defined in claim 8; and further comprising first thread holder means provided between the thread guide and said plurality of thread supplies so as to normally hold said first thread extending between said first thread supply and the thread guide.

10. A thread splicing apparatus as defined in claim 9; and further comprising second thread holder means provided between said first thread holder means and said plurality of thread supplies, said second thread holder means including individual thread holder elements each provided so as to hold one end of each thread drawn out from each of said thread supplies of said plurality of thread supplies.

11. A thread splicing apparatus as defined in claim 8, wherein said thread pick-up face is formed with a longitudinal groove.

12. A thread splicing apparatus as defined in claim 8, wherein said thread selecting means includes a turret provided so as to carry said plurality of thread supplies, and a pulse motor for rotating said turret in one direction with respect to said thread pick-up position.

13. A thread splicing apparatus as defined in claim 10; and further comprising a reversible motor for rotatably moving said thread pick-up means between said first and said second thread holder means to enable said thread pick-up means to pick up said ends of said first and second threads.

14. A thread splicing apparatus as defined in claim 10, wherein said cutter means is provided so as to cut said first thread at a point between said first and said second thread holder means.

* * * * *